United States Patent [19]

Braun

[11] Patent Number: 4,956,653

[45] Date of Patent: Sep. 11, 1990

[54] BUBBLE JET PRINT HEAD HAVING IMPROVED MULTI-LAYER PROTECTIVE STRUCTURE FOR HEATER ELEMENTS

[75] Inventor: Hilarion Braun, Xenia, Ohio

[73] Assignee: Eastman Kodak Company, Rochester, N.Y.

[21] Appl. No.: 350,867

[22] Filed: May 12, 1989

[51] Int. Cl.[5] ..... B41J 2/05

[52] U.S. Cl. ..... 346/140 R

[58] Field of Search ..... 346/140

[56] References Cited

U.S. PATENT DOCUMENTS

| | | | |
|---|---|---|---|
| 4,335,389 | 6/1982 | Shirato et al. | 346/140 |
| 4,370,668 | 1/1983 | Hara et al. | 346/140 |
| 4,412,224 | 10/1983 | Sugitani | 346/140 X |
| 4,450,457 | 5/1984 | Miyachi et al. | 346/140 |
| 4,513,298 | 4/1985 | Scheu | 346/140 |
| 4,567,493 | 1/1986 | Ikeda et al. | 346/140 |
| 4,577,202 | 3/1986 | Hara | 346/140 |
| 4,596,994 | 6/1986 | Matsuda et al. | 346/140 |
| 4,686,544 | 8/1987 | Ikeda et al. | 346/140 |

*Primary Examiner*—Joseph W. Hartary
*Attorney, Agent, or Firm*—John D. Husser

[57] ABSTRACT

An improved protective construction for a bubble jet print head device of the kind having a substrate with a plurality of separately addressable resistive heater portions that are formed by address and common electrodes. The protective construction includes a first layer of dielectric material formed over the heater portions, a second layer of metal formed over the first layer, and a third layer having a physically hard and chemically inert outer surface portion overlying the second layer.

11 Claims, 2 Drawing Sheets

BUBBLE JET PRINT HEAD HAVING IMPROVED MULTI-LAYER PROTECTIVE STRUCTURE FOR HEATER ELEMENTS

FIELD OF INVENTION

The present invention relates to thermal, drop-on-demand, ink jet print heads (termed herein "bubble jet" print heads) and more specifically, to constructions of such print heads that provide improved protection for their resistive heater elements.

BACKGROUND ART

Typically, in bubble jet print heads a plurality of electrically resistive heater elements are formed on a support substrate, e.g. formed of metal or ceramic material and having a heat control coating e.g. $SiO_2$. Metal electrodes are formed to selectively apply voltage across the heater elements and a protective coating is provided over the heater elements and electrodes. Printing ink is supplied between the heater elements and orifices of the print head and a heater is energized to a temperature that converts the adjacent ink to steam rapidly, so that a shock wave causes ejection of ink from the related orifice.

This ink jet printing approach is becoming increasingly useful; however, a major problem still exists in providing print heads wherein the heater elements are capable of a long operative life, particularly when used in high speed printing modes. Primarily, this is because protecting the drop ejectors from physical and chemical damage still presents a major technical problem.

Thus, the inks that are utilized can chemically attack the heater elements and effect short-circuits between their address and ground electrodes. More specifically, the resistor is an electrically energized device and the ink is an electrolyte. Any device that causes an electric current to flow through an electrolyte will cause electrolytic dissolution at the positive electrode and electrolytic plating at the negative electrode. Therefore the resistor will tend to be dissolved at the positive end, while having electrolytic material deposited at the negative end, unless the resistor is shielded from the electrolyte. For these reasons, and other reasons, e.g. protection against mechanical damage, a dielectric protective layer(s) are provided over the heater element (and usually over the electrodes). The provision of such dielectric protective layers over the heaters reduces problems such as mentioned above, but introduces additional difficulties, e.g. in regard to the efficient transfer of heat from the heater to the ink and the reliable attachment of such layers to the heater and electrodes.

U.S. Pat. Nos. 4,450,457 and 4,577,202 describe the above and other problems and provide some exemplary listings of desired protective layers characteristics, for example having a good resistance to heat and ink damage, having a good heat conductivity, having an ink penetration preventive property, having an oxidation preventing property and having a resistance to mechanical damage. To achieve such characteristics, the noted patents teach use of a two layer composite protective cover comprising a dielectric. e.g. $SiO_2$ or immediately over the heater element and a metal layer e.g. Ta or metal alloy, as the top layer. U.S. Pat. No. 4,513,298 describes another composite protective layer construction using silicon nitride as the first overlying layer, but using silicon carbide as the top protective layer.

While the protective layer approaches described above are useful, they still are subject to operative failure in less than the desired life span.

SUMMARY OF INVENTION

One significant purpose of the present invention is to provide, for the heater elements of bubble jet print heads, new protective constructions, which improve their operative performances, e.g. by extending the print head life span and/or enabling higher speed printing operation. The new approach of the present invention provides a construction that is highly useful in reducing the occurrence of prior art print head failure modes.

Thus, in one preferred embodiment, the present invention constitutes an improved protective construction for a bubble jet print head device of the kind having a substrate with a plurality of separately addressable resistive heater elements which are formed by address and common electrode pairs that provide electrical energy flow to and from spaced terminal portions of such elements. The improved construction comprises a heater element Protective cover that includes a first layer of dielectric material formed on the heater elements; a second layer of metal formed on the first layer and overlying the heater elements; and a third layer having a physically hard and chemically inert outer surface portion overlying the first and second layers and the heater elements.

BRIEF DESCRIPTION OF DRAWINGS

The subsequent description of preferred embodiments refers to the accompanying drawings wherein.

DETAILED DESCRIPTION OF PREFERRED EMBODIMENTS

Figure 1:
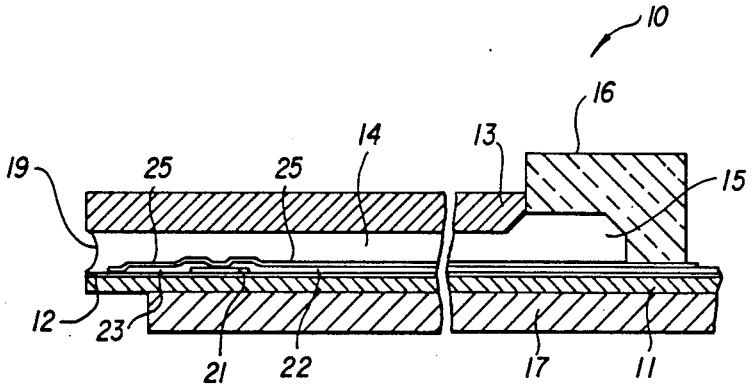
FIG. 1 (PRIOR ART)
FIG. 1 is a cross-sectional view of one kind prior art ink jet print head in which the present invention can be utilized.

Referring to FIG. 1 the prior art bubble jet head 10 comprises in general, a base substrate 11 formed of thermally conductive material, such as silicon, on which is coated a heat control layer 12 such as $SiO_2$ or a non thermally conductive material such as glass. A grooved top plate 13 defines a plurality of ink supply channels 14 leading from an ink supply reservoir 15, formed by a top end cap 16. A heat sink portion 17 can be provided on the lower surface of substrate 11 if the characteristics of that substrate warrant. Located upstream from the orifices 19, formed between the grooves of top plate 13 and substrate 11, are a plurality of selectively addressable electro-thermal transducers denoted generally 20. These transducers each comprise a discrete resistive heater portion 21, formed e.g. of $Z_rBr_2$, and a discrete address electrode 22 formed e.g. of aluminum. A common ground electrode 23 can be coupled to the edge of each heater element opposite its address electrode. The electrodes and heater elements can be formed on the surface of layer 12 by various metal deposition techniques.

Formed over both the electrodes and heater elements is a protective layer(s), e.g. of $SiO_2$, intended to meet the various requirements described in the background section above. Upon application of an electrical potential to the address electrodes 22, current flows through the resistive heater element 21 to the ground electrode 23 and heat is provided to vaporize the ink proximate the heater element and eject an ink drop through orifice 19.

Figure 2:
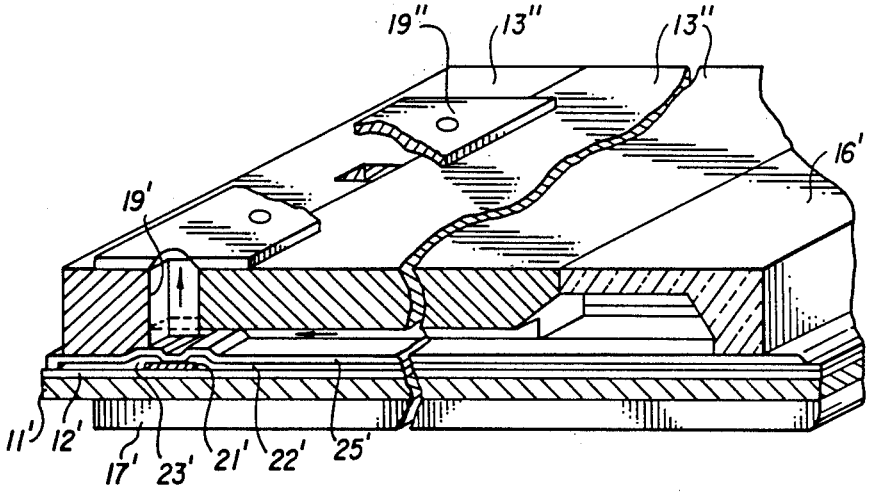
FIG. 2 (PRIOR ART)
FIG. 2 is a perspective view, partially in cross-section, of another kind of prior art print head device in which the present invention can be utilized.

FIG. 2 illustrates another prior art bubble jet print head embodiment which has components similar to the FIG. 1 embodiment that are indicated by corresponding "primed" numerals. The primary difference in the FIG. 2 prior art print head is that the top plate comprises separate components 13', 13'', which cooperate to provide top ejection passages 19' and an orifice plate 19'' is provided over the passages 19'. Upon application of potential to address electrodes 22', current passes through heater 21' to ground electrode 23' and ink is heated to eject a drop through the related orifice of plate 19''.

Figure 3:
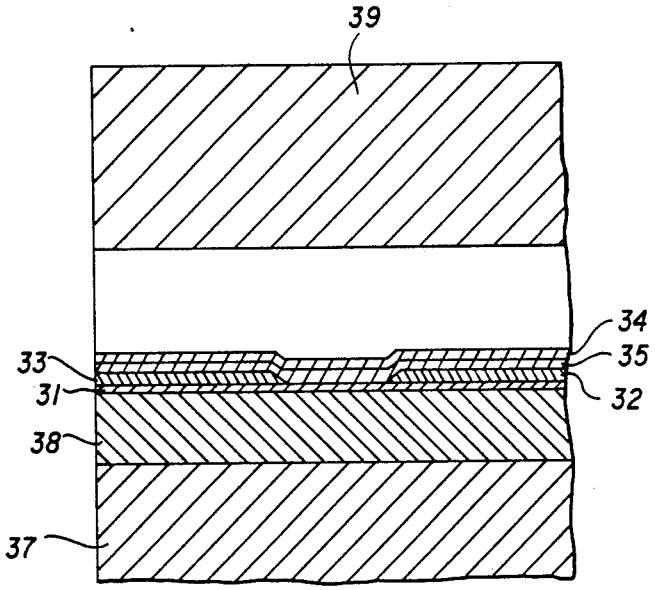
FIG. 3 (PRIOR ART)
FIG. 3 is a cross-section view showing in more detail the protective covering constructions utilized in prior art devices such as shown in FIGS. 1 and 2.

FIG. 3 illustrates, in cross-section, an enlarged view of the drop ejection zone of a bubble jet print head, similar to those shown in FIG. 1 and FIG. 2, but having a different prior art embodiment of protective covering overlying the heater elements 31, and their energizing electrodes 32, 33. In the FIG. 3 device, the protective covering comprises a two layer construction having a top layer 34 and an intermediate layer 35, which contacts the heater elements and electrodes. U.S. Pat. Nos. 4,335,389 and 4,370,668 disclose various materials that can be used to form such two layer protective coverings. In general, the top layer is formed to physically and chemically protect and comprises a material with dense particle structure, high tensile strength and good fatigue characteristic. Metals, metal alloys and carbides are among other materials described as useful for the top layer 34. The intermediate layer 35 is selected to have a resistivity e.g. $10^4$ greater than that of heater layer 31 so that current flows through the heater element, not layer 35. Oxides and nitrides, e.g. $SiO_2$ and $Si_3O_4$, among other materials, are described as useful for layer 35. The substrate 37 can be formed of metal and have a heat control layer 38 e.g. $SiO_2$. The top plate 39 can comprise metal, glass or plastic with ink groove structures.

Figure 4:
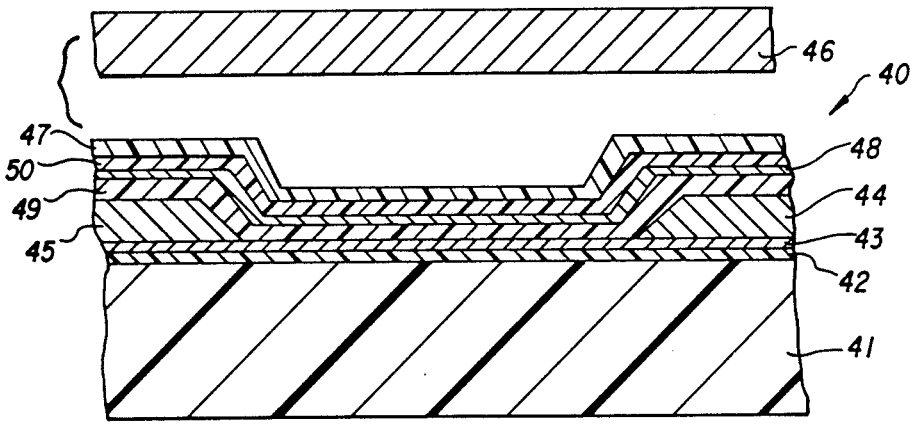
FIG. 4 is a cross-sectional view, similar to FIG. 3, but showing a portion of a print head that incorporates a protective covering construction in accord with the present invention.

FIG. 4 shows in cross-section an improved protective covering construction which I have discovered based on my analysis of the primary failure modes of prior art devices such as described above. In general, I have found that the predominant failure mode is crazing, followed by electrolytic dissolution. More specifically, the critical temperature of water and glycol, typical ink fluids, lies near 310° C. and should be reached in less than 3 μsec., in order to avoid boiling of the ink prior to "exploding" it. When the device's heater elements and their protective covering are rapidly heated, and then cooled, they expand and contract violently, causing very large stresses in both the heater elements and their coverings. Moreover, bubble jet print head drop ejectors heat and cool thousands of times per second.

I have found that it is particularly important that attached protective layers, particularly the top protective layers, are capable of being rapidly heated and quenched without crazing. Silicon carbide is an excellent choice of material for the top layer because of its excellent resistance to crazing, as well as its resistance to chemical attack and scratching. However, at high temperature silicon carbide becomes conductive and subject to electrolytic attack. The provision of a relatively thick layer (e.g. over several thousand Angstroms) of silicon nitride, or other such dielectric material, between the silicon carbide and the heater electrodes can reduce the electrical field operative at silicon carbide ink interface. In relatively thin layers, such dielectric intermediate layers exhibit electrical conductivity at high temperatures, leading to leakage currents that result in electrolytic damage. Crazing of one or more of the protective layers results in similar leakage currents. However, as the thickness of such a dielectric intermediate layer increases, it becomes a larger thermal barrier to heat transfer from the heater to the ink.

Based on my analysis of this dilemma, I discovered that a metal film located beneath the outer layer, but dielectrically separated from the heater and electrodes, will effectively shield the electric fields that cause such electrolytic damage. When such a subsurface electric film is provided; (i) an exterior layer, such as a silicon carbide layer, can be used to provide its desired characteristic, and (ii) a dielectric intermediate layer(s), e.g. silicon nitride, can be used with a layer thinness that provides useful thermal gradients across the heater-to-ink gap. In addition, the metal film provided in accord with the present invention enhances strength and craze resistance of the protective coating, but at a location where the metal film itself is not exposed to chemical attack.

The device 40 shown in FIG. 4 is constructed in accord with one preferred embodiment of the present invention and comprises a base substrate 41, e.g. silicon, glass or metal, a heat control layer 42, e.g. $SiO_2$, a resistive heater 43, e.g. $TaAl_3$ and ground and address electrodes 44, 45, e.g. formed of aluminum. A top member 46 can be formed as shown in FIGS. 1 or 2, e.g. of metal or plastic In accord with the present invention the protective covering for the heater and electrodes can comprise an outer layer 47 having an outer surface that is physically hard craze resistant and resistant to chemical attack, an intermediate layer 48 comprising a metal film beneath the outer layer and a high resistance dielectric layer 49 separating the metal film layer 48 from the heater and electrodes. Preferably, another dielectric layer 50 is provided between the metal film and outer layer to enhance adhesion of the top layer 47.

In general, the dielectric layer 49 between the resistive layer 43 and metal film layer 48 should be of a thickness to be safely beyond the dielectric breakdown of the material used at the operative voltages. In preferred embodiments, the dielectric layer 49 can have a thickness in the range of about 2–6 thousand Angstroms and the metal layer 48 can have a thickness in the range of about 1–6 thousand Angstroms. In a particularly preferred embodiment, the first overcoat layer 49 comprises silicon nitride of thickness of about 2 to 3 thousand Angstroms, the metal film layer 48 comprises tantalum aluminum of thickness of about 1 to 2 thousand Angstroms, the adhesion layer 50 comprises silicon nitride of thickness of about 0.5 to 1 thousand Angstroms and the outer layer 47 comprises silicon carbide of thickness of about 1 to 2 thousand Angstroms.

The invention has been described in detail with particular reference to certain preferred embodiments thereof, but it will be understood that variations and modifications can be effected within the spirit and scope of the invention.

I claim:

1. In a bubble jet print head device of the kind having a substrate with a plurality of separately addressable resistive heater portions that are formed by address and common electrode pairs that provide electrical energy flow to and away from spaced edges of such heater portions, an improved protective cover construction for such heater portions comprising:

(a) a first layer of dielectric material formed on said heater portions;

(b) shielding meand, including a second layer of metal formed on said first layer and overlying said electrode pairs and said heater portions, for shielding a subsequently overlying layers(s) from localized electrical fields of said electrode pairs; and (c) a third layer having a physically hard, scratch resistant and chemically inert outer surface portion overlying said first and second layers and said heater portions.

2. The invention defined in claim 1 wherein said outer surface portion of said third layer is a carbide.

3. The invention defined in claim 2 wherein said third layer comprises a silicon carbide outer surface portion and a silicon nitride portion attaching said outer surface portion and said metal layer.

4. The invention defined in claim 3 wherein said first layer comprises silicon nitride.

5. The invention defined in claim 4 wherein said metal layer is tantalum aluminide.

6. The invention defined in claim 1 wherein said first layer is about 2.0 to 6.O kÅ in thickness, said second layer is about 1.0 to 6.0 kÅ in thickness.

7. The invention defined in claim 6 wherein said third layer is about 1.5 to 3.0 kÅ in thickness.

8. The invention defined in claim 7 wherein said third layer comprises an outer portion of silicon carbide about 1–2 kÅ in thickness and an inner portion of silicon nitride about 0.5 to 1 kÅ in thickness.

9. In a bubble jet print head device of the kind having a substrate with a plurality of separately addressable resistive heater portions that are formed by address and common electrode pairs that provide electrical energy flow to and away from spaced edges of such heater portions, an improved protective cover construction for such heater portions comprising:

(a) a first layer of silicon nitride having a thickness of about 2.0 to 6.0 kÅ formed on said heater portions;

(b) a second layer of $TaAl_3$ having a thickness of about 1.0 to 6.0 KÅ formed on said first layer and overlying said heater portions; and (c) a third layer having a physically hard and chemically inert outer surface portion overlying said first and second layers and said heater portions.

10. The invention defined in claim 9 wherein said outer surface portion of said third layer is a carbide.

11. The invention defined in claim 10 wherein said third layer comprises a silicon carbide outer surface portion and a silicon nitride portion attaching said outer surface portion and said metal layer.

* * * * *